US005106715A

United States Patent [19]

Matsumura et al.

[11] Patent Number: 5,106,715

[45] Date of Patent: Apr. 21, 1992

[54] TONER COMPOSITION WITH POLYETHYLENE AND INORGANIC EXTERNAL ADDITIVE

[75] Inventors: Yasuo Matsumura; Chiaki Suzuki; Ikutaroh Nagatsuka; Koichi Kumashiro; Masao Mochizuki, all of Kanagawa, Japan

[73] Assignee: Fuji Xerox Co., Ltd., Tokyo, Japan

[21] Appl. No.: 306,717

[22] Filed: Feb. 6, 1989

[30] Foreign Application Priority Data

Feb. 10, 1988 [JP] Japan ..... 63-27425

[51] Int. Cl.[5] ..... G03G 9/087; G03G 9/097

[52] U.S. Cl. ..... 430/110; 430/111

[58] Field of Search ..... 430/109, 126, 110, 111

[56] References Cited

U.S. PATENT DOCUMENTS

| | | | |
|---|---|---|---|
| 2,297,691 | 10/1942 | Carlson | 430/31 X |
| 3,079,342 | 2/1963 | Insalaco | 430/110 |
| 3,392,139 | 7/1968 | Dingman | 430/106 |
| 3,840,464 | 10/1974 | Van Engeland | 430/108 |
| 3,933,665 | 1/1976 | Van Engeland | 430/109 |
| 3,965,021 | 6/1976 | Clemens | 430/109 |
| 4,108,653 | 8/1978 | Peters | 430/109 X |

FOREIGN PATENT DOCUMENTS 62-250470 10/1987 Japan .

OTHER PUBLICATIONS

Herman et al., Treatise on Materials Science and Tech., vol. 10, Part A (1977) pp. 48-53, Academic Press.

*Primary Examiner*—Roland Martin

*Attorney, Agent, or Firm*—Finnegan, Henderson, Farabow, Garrett and Dunner

[57] ABSTRACT

A toner composition for thermal fixing is disclosed, comprising a colorant, an external additive and a binder resin that contains a thermoplastic resin having a glass transition point of from 20° C. to less than 50° C. and a polyolefin polymer having an average molecular weight of 800 or more, the polyolefin polymer being present in an amount of from 5 wt % to less than 50 wt % of the total binder resin.

11 Claims, No Drawings

TONER COMPOSITION WITH POLYETHYLENE AND INORGANIC EXTERNAL ADDITIVE

FIELD OF THE INVENTION

The present invention relates to a toner composition for use in the development of latent electrostatic images formed in electrophotography, electrostatic recording and like processes. More particularly, the present invention relates to a toner composition that is adapted for thermal fixing.

BACKGROUND OF THE INVENTION

In electrophotographic processes, a latent electrostatic image formed on a photoreceptor is usually developed with a pigment-containing resin powder. The resulting visible image is transferred onto a receiving sheet and subsequently fixed on the receiving sheet by application of either heat or pressure, or both. Recently, there has been a growing need for more rapid and efficient image fixing. To meet this need, the use of heated rolls as a fixing means has become popular in many modern electrophotographic systems.

In the method of fixing images with heated rolls, it is effective to lower either the softening point or melt viscosity of the binder material used for the toner in order to realize rapid fixing with lower power consumption. However, with the binder polymers (binder resins) which are commonly used as principal binding materials for toners, a lowering of the softening point often results in an increase in the change of "caking" (or "blocking") during toner storage, which will lead to reduced flowability of the toner. If the melt viscosity of the binder polymer is reduced, offsetting phenomena (such as where the unfixed toner image adheres to the surface of a fixing roller, e.g., a heated roller) will occur and the change of image fouling is increased.

In order to avoid these problems, various ideas have been proposed: one is to prevent offsetting phenomena by supplying a mold releasing agent such as silicone oil to heating rollers; another is to increase the glass transition temperature of the principal binder polymer of the toner; still another approach is to prevent caking during storage by applying fine particles of an inorganic material such as silica, titania, alumina, or of an organic material such as PMMA (Polymethylmethacrylate), as an external additive (e.g., prevent caking by adding fine particles having a particle size smaller than the toner particles on the outer surface of the toner particles).

High-molecular weight resins have conventionally been used as binding materials in toners. To make toners, the resins are mixed with pigments (e.g., carbon black), charge control agents and any other necessary additives by a suitable method such as kneading, and the resulting mixture is ground into fine particles. In this case, the binder resin retains the pigments and other constituent materials, and the toner softens upon application of either heat or pressure, or both, during fixing, whereupon the toner particles are deposited on and affixed to the microscopically undulating surface (i.e., surface having roughness) of the receiving sheet.

The prior art methods, however, have various problems. In order to supply silicone oil to heated rolls, a feed mechanism is necessary, and this adds to the cost of the apparatus. Furthermore, maintenance work becomes necessary in association with oil replenishment. If the glass transition temperature of the binder resin is adjusted to too a high level, its softening point will be increased so as to make it difficult to achieve successful fixing at low temperatures. If the glass transition temperature of the binder resin is lowered too much, the toner becomes more prone to caking.

SUMMARY OF THE INVENTION

The present invention has been developed to solve the aforementioned problems of the prior art toner compositions.

An object, therefore, of the present invention is to provide a toner composition that allows fixing to be performed efficiently at high speed.

Another object of the present invention is to provide a toner composition that will not easily cake during storage.

These and other objects of the present invention can be attained by a toner composition for thermal fixing comprising particles of a binder resin comprising (1) a thermoplastic resin having a glass transition temperature of from about 20° C. to less than about 50° C. and (2) a polyolefin polymer having an average molecular weight of 800 or more, the polyolefin polymer being present in an amount of from 5 wt % to less than 50 wt % of the total binder resin; a colorant; and particles of an external additive on the surface of the toner particles.

Particularly preferred thermoplastic resins for use in the present invention are styrene-acryl based resins and polyester resins having average molecular weight of at least 2,000. The preferred polyolefin polymers for use in the present invention are polyolefins having a high degree of crystallinity and an average molecular weight of from 800 to 100,000, especially polyethylene having an average molecular weight of from 2,000 to 6,000 and a crystallinity of from 75 to 90%.

DETAILED DESCRIPTION OF THE INVENTION

As described in connection with the prior art, toners become prone to caking if the glass transition temperature of the binder resin is lowered. It has been found, however, that a toner containing a large amont of a polyolefin polymer has better blocking resistance (i.e., caking resistance) than a toner containing a smaller amount of the polyolefin polymer. A plausible explanation of this phenomenon is that polyolefin polymers are not highly miscible with ordinary binder resins, and, if their content exceeds a certain level, the polyolefin portion may agglomerate into large masses that will prevent toner particles from adhering to one another. Highly crystalline polyolefin polymers are, in most cases, less prone to caking, due to becoming plastic, than ordinary amorphous thermoplastic resins. Furthermore, polyolefin polymers have a tendency to yield at comparatively low pressures, so that they will enhance the fixability of a toner image under pressure, thereby allowing the minimum fixing temperature to be substantially lowered.

The present inventors found that with the combination of an ordinary amorphous thermoplastic resin and polyolefin polymer, the use of thermoplastic resin having a glass transition temperature of from 20° C. to less than 50° C. was possible and effective for the purpose of reducing the minimum fixing temperature.

In the present invention, if the glass transition temperature of the thermoplastic resin is 50° C. or higher, the addition of a polyolefinic polymer has little effect in reducing the fixing temperature or providing increased resistance to caking. If the glass transition temperature of the thermoplastic resin is less than 20° C., the addition of a polyolefin polymer is also ineffective in providing sufficient anti-blocking property.

The polyolefin polymer used in the present invention must have an average molecular weight of at least 800, and its maximum average molecular weight is preferably 100,000 and more preferably 20,000. If the molecular weight of the polyolefin polymer is less than 800, the resulting toner will have an increased tendency to form a film, that is, the toner filming property wherein toner particles are adhered in the form of a thin film on the surface of the photoreceptor by softening of the binder resin is increased, and fouling of the photoreceptor or other parts of a copying machine becomes a problem. Furthermore, the fixed image has such a low density that copy paper, fingers, or the like become soiled easily when rubbed against the fixed image.

The content of the polyolefin polymer in the binder resin must be at least 5 wt %, but at the same time, it must be less than 50 wt % of the binder resin. Preferably, the content of the polyolefin polymer is from 5 to 40 wt % and, more preferably, the content of the polyolefin polymer is from 5 to 20 wt % of the binder resin. If such content is less than 5 wt %, the polyolefin polymer is entirely ineffective, and blocking resistance and fixing property at lower temperatures deteriorate. If the polyolefin polymer content is 50 wt % or more, the tendency of the binder resin to yield under pressure at ordinary temperatures becomes abnormally high, and the resulting toner will be so poorly flowable that it will not be suitable for practical use.

Examples of thermoplastic resins that have a glass transition point (temperature) of from 20° C. to less than 50° C. and which are suitable for use in the present invention include copolymers of vinyl monomers, and various polyester resins. Illustrative vinyl monomers include: styrenes such as styrene and parachlorostyrene; vinyl naphthalene; vinyl esters such as vinyl chloride, vinyl bromide, vinyl fluoride, vinyl acetate, vinyl propionate, vinyl benzoate and vinyl butyrate; methylene aliphatic carboxylic acid esters such as methyl acrylate, ethyl acrylate, n-butyl acrylate, isobutyl acrylate, dodecyl acrylate, n-octyl acrylate, 2-chloroethyl acrylate, phenyl acrylate, methyl α-chloroacrylate, methyl methacrylate, ethyl methacrylate and butyl methacrylate; acrylonitrile, methacrylonitrile and acrylamide; vinyl ethers such as vinyl methyl ether, vinyl isobutyl ether and vinyl ethyl ether; vinyl ketones such as vinyl methyl ketone and vinyl ethyl ketone; and N-vinyl compounds such as N-vinylpyrrole, N-vinylcarbazole, N-vinylindole and N-vinylpyrrolidone. Among the resins listed above, those which have a glass transition point of from at least 20° C. to less than 50° C. and, preferably, from 35° C. to less than 50° C. (as measured by differential scanning calorimetry (DSC) as described in Polymer Society, *Polymer Measurement*, "Structure and Physical Property", The Baihukan, Vol. 1, pages 151-154 and 181-185, M. J. O'Neill, *Anal. Chem.*, 36, (7), 1238 (1964) and R. A. W. Hill, R. P. Slessor; Trans. Faredy Soc., 65(2), 340 (1969)) a number average weight of at least 500 and a weight average molecular weight (i.e., an average molecular weight of at least 2,000 are particularly preferred. If the glass transition temperature is more than 50° C., the fixing property at lower temperatures is deteriorated. Therefore, styrene-acryl based resins or polyester based resins are particularly preferred.

Illustrative polyolefin polymers that can be used in the present invention are homo- and copolymers of monomers including ethylene; propylene; butylene; cyclohexylpropyl ethylene; decyl ethylene; dodecyl ethylene; 1-ethyl ethylene; 1-ethyl-1-methyl-tetramethylene; ethyl-2-propylene; heptyl ethylene; hexyl ethylene; isopentyl ethylene; 1,1-dimethyl ethylene; 1-methyl octaethylene; 1,1-dimethyl trimethylene; 1,1-dimethyl tetraethylene; nonyl ethylene; octyl ethylene; pentyl ethylene and tetradecyl ethylene. Among these, a preferred polyolefin polymer is a polyethylene having an average molecular weight of from 2,000 to 6,000 and, preferably, from 2,000 to 4,000, and a crystallinity of from 75 to 90% and, preferably, from 85 to 90%. For exmaple, "200 p" and "400 p" (manufactured by Mitsui Petrochemical Industries, Ltd.) are preferred.

Further, the toner composition of the present invention can include externally added fine particles of an inorganic material as an external additive. The fine particles of an external additive function to prevent blocking between the toner particles.

Examples of useful external inorganic additives include silica, aluminum oxide, titanium dioxide, zinc oxide, etc. The particle size of the external additive is generally from 5 to 100 mμ and preferably from 10 to 50 mμ. The content of the external additives is generally from 0.2 to 5.0 wt % and preferably from 0.5 to 2.0 wt %, of the total weight of the toner composition. The external additives can be added to the toner composition using conventional addition methods such as mixing or blending the toner (toner particles) and the external additives in a Henschel mixer, a V-type blender, or the like.

The colorant in the toner composition of the present invention may be selected from those in common use including pigments (e.g., carbon black) and dyes. Any suitable pigment or dye may be employed as the colorant if needed or desired. Examples include carbon black, nigrosine dye, aniline blue, Calco oil Blue, Chrome yellow, ultramarine blue, duPont Oil Red, quinoline yellow, methylene blue chloride, phthalocyanine blue, Malachite Green Oxalate, lamp black, Rose Bengal and mixtures thereof. Magnetic powders such as $Fe_2O_3$ and $Fe_3O_4$ may also be used as a colorant.

The toner composition of the present invention may further contain mold releasing agents (e.g. waxes) and charge control agents as described in JP-A-62-250470 (The term "JP-A" as used herein means an "unexamined, published Japanese patent application").

The toner particles of the present invention have a particle size of generally from 2 and 20 μm and more preferably, from 5 to 15 μm.

EXAMPLE

Toner samples were prepared from combinations of thermoplastic resins and polyolefin polymers in the proportions as shown in Table 1. the thermoplastic resins were styrene/n-butyl methacrylate copolymers (number average molecular weight: 15,000; weight average molecular weight (i.e., average molecular weight): 60,000) having the glass transition temperatures shown in Table 1. The polyolefin polymers were polyethylene waxes having the average molecular weights shown in Table 1. In Comparative Sample D, paraffin wax was used instead of polyethylene wax. Each of the combinations was kneaded with 10 wt % of carbon black and the mixture was ground into particles having an average particle size of 11 μm. A charge control agent was not incorporated in these toner samples. A fine silica powder (0.5 parts by weight) was applied to the surfaces of the toner particles to obtain toner composition samples.

These toner composition samples were mixed with an iron powder (particle size: 100 μm) carried coated with polymethyl methacrylate to make developers. Using these developers, evaluations of the minimum temperature necessary for fixing on heated rolls were conducted with an electrophotographic copier adapted from Model FX 3500 of Fuji Xerox Co., Ltd. The termperature at which the fixed image could be rubbed five times with a cotton cloth without causing defacing of characters in the image was used as the standard for evaluation. The developers were also subjected to the caking test by allowing the developer to stand in a high temperature atmosphere (42° C.) for 24 hours. The degree of caking was evaluated or functionally, and the results are shown in Table 1. In Table 1, A indicates no problem; C indicates extensive caking; and B indicates moderate caking.

TABLE 1

| Sample | Thermoplastic resin | | Polyolefinic polymer | | | Minimum fixing temperature, (°C.) | Caking test |
|---|---|---|---|---|---|---|---|
| | Glass transition point, (°C.) | Parts by weight | Type | Molecular weight | Parts by weight | | |
| A (Comparison) | 18 | 50 | 200 p | 2,000 | 40 | 95 | C |
| B (Invention) | 40 | 50 | 200 p | 2,000 | 40 | 110 | A |
| C (Comparison) | 55 | 50 | 200 p | 2,000 | 40 | 150 | A |
| D (Comparison) | 40 | 50 | paraffin wax | 700 | 40 | defaced by rubbing | C |
| E (Invention) | 40 | 45 | 100 p | 900 | 45 | 105 | A |
| F (Comparison) | 40 | 35 | 100 p | 900 | 55 | 105 | A (poor flowability) |
| G (Invention) | 40 | 83 | 100 p | 900 | 7 | 120 | A |
| H (Comparison) | 40 | 86 | 100 p | 900 | 4 | 130 | B |
| I (Comparison) | 40 | 90 | — | — | — | 130 | B |

As is apparent from the results of Table 1, toner samples B, E and G prepared in accordance with the present invention allowed fixing at low minimum temperatures and performed satisfactorily in the caking test.

The toner composition of the present invention which is adapted for thermal fixing employs a binder resin in which a thermoplastic resin having a glass transition point (temperature) of from 20° C. to less than 50° C. and a polyolefin polymer having a weight average molecular weight (i.e., average molecular weight) of at least 800 are combined in specified proportions. A toner image produced by developing a latent electrostatic image with this toner composition can be thermally fixed rapidly and efficiently. It has the added advantage of being less prone to caking during storage.

Having described embodiments of the present invention it is to be understood that variations and modifications thereof within the spirit and scope of the invention may become apparent to those skilled in the art and that the scope of the present invention is defined only by the appended claims and their equivalents.

What is claimed is:

1. A toner composition for thermal fixing comprising:

particles of a binder resin consisting essentially of (1) a thermoplastic resin having a glass transition temperature of from at least 20° C. to less than 50° C. and (2) a polyethylene wax having a weight average molecular weight of from 800 to 20,000 and having a crystallinity of from 75 to 90%, said polyethylene wax being present in an amount of from at least 5 wt % to less than 50 wt % of the total binder resin;

a colorant; and particles of an external inorganic additive on the surface of the toner particles.

2. The toner composition for thermal fixing as claimed in claim 1, wherein said glass transition temperature is from 35° C. to less than 50° C.

3. The toner composition for thermal fixing as claimed in claim 1, wherein the content of said polyethylene wax is from 5 wt % to 40 wt % of said binder resin.

4. The toner composition for thermal fixing as claimed in claim 1, wherein said polyethylene wax has a weight average molecular weight of from 2,000 to 6,000.

5. The toner composition for thermal fixing as claimed in claim 1, wherein said thermoplastic resin is a styrene-acryl based resin or a polyester resin.

6. The toner composition for thermal fixing as claimed in claim 5, wherein the weight average molecular weight of said thermoplastic resin is at least 2,000.

7. The toner composition for thermal fixing as claimed in claim 1, wherein said external additive is fine particles of at least one inorganic material selected from the group consisting of silica, aluminum oxide, titanium dioxide, zinc oxide.

8. The toner composition for thermal fixing as claimed in claim 1, wherein said external additive has a particle size of from to 5 to 100 mμ.

9. The toner composition for thermal fixing as claimed in claim 1, wherein said external additive has a particle size of from 10 to 50 mμ.

10. The toner composition for thermal fixing as claimed in claim 1, wherein the content of said external additive is from 0.2 to 5.0 wt % of the total weight of the toner composition.

11. The toner composition for thermal fixing as claimed in claim 1, wherein the content of said external additive is from 0.5 to 2.0 wt % of the total weight of the toner composition.

* * * * *